US005082031A

United States Patent [19]

Suhr

[11] Patent Number: 5,082,031

[45] Date of Patent: Jan. 21, 1992

[54] FLEXIBLE CABLE INTERMEDIATE SUPPORT FOR A HEDDLE FRAME

[76] Inventor: Robert N. Suhr, 431 Chowning Pl., Marietta, Ga. 30064

[21] Appl. No.: 750,414

[22] Filed: Aug. 27, 1991

Related U.S. Application Data

[63] Continuation-in-part of Ser. No. 558,230, Jul. 26, 1990.

[51] Int. Cl.[5] ..... D03C 9/06

[52] U.S. Cl. ..... 139/91

[58] Field of Search ..... 403/291, 388; 52/426, 52/223 L, 808, 227, 228, 408, 410, 729, 230, 787; 249/215, 216, 217; 139/91, 92

[56] References Cited

U.S. PATENT DOCUMENTS

| | | | |
|---|---|---|---|
| 1,637,796 | 8/1927 | Andrews | 139/91 |
| 1,645,571 | 10/1927 | Andrews | 139/91 |
| 1,767,834 | 6/1930 | Carlson | 249/217 |
| 1,820,509 | 8/1931 | Toogood | 249/216 X |
| 3,937,607 | 2/1976 | Rodormer | 52/223 L X |
| 3,965,543 | 6/1976 | Connors | 52/223 L X |
| 4,598,519 | 7/1986 | Reid | 52/426 |
| 4,924,916 | 5/1990 | Faasse et al. | 139/91 |

*Primary Examiner*—Andrew M. Falik

*Attorney, Agent, or Firm*—Vivian L. Steadman; Harry I. Leon

[57] ABSTRACT

An intermediate support for a weaving heddle frame in which heddle carrying rods are affixed to the frame stave, the support transmitting both tensile and compressive forces between these rods. The support can be disengaged from the lower heddle carrying rod simply by loosening a fastener at the top of the support and can then be swung upwardly to clear the space between the two heddle carrying rods. The support comprises a flexible cable, partially surrounded by at least one rigid hollow segment. Tension forces in the cable and compressive forces in the rigid hollow member hold the upper and lower heddle carrying rods, as well as the upper and lower frame staves affixed thereto, in a predetermined parallel relationship.

11 Claims, 2 Drawing Sheets

FLEXIBLE CABLE INTERMEDIATE SUPPORT FOR A HEDDLE FRAME

CROSS-REFERENCE TO RELATED APPLICATION

This application is a continuation-in-part of my earlier copending application, Ser. No. 558,230, filed July 26, 1990 allowed.

BACKGROUND OF THE INVENTION

1. Field of the Invention

This invention relates to weaving and more particularly to an improved flexible intermediate support for a weaving heddle frame.

2. Discussion of the Prior Art

As is well known, weaving comprises interlacing warp and filling yarns according to a predefined pattern. Each individual warp yarn is threaded through a heddle. The heddles are held in a weaving heddle frame. Each frame can be raised or lowered as desired, thus controlling the position of its heddles and warp yarn. That is, each respective set of warp yarns controlled by one of the frames can be raised or lowered relative to the other sets of warp yarns. A shuttle motion is used to pass the filling yarn under the warp yarns that have been raised by the frames and to pass it over those warp yarns that have been lowered by the remaining frames. The process is repeated with the frames being shifted so as to raise new sets of warp yarns and lower others between successive passes of the shuttle until the fabric is woven.

Weaving heddle frames, presently in industrial use, have upper and lower frame staves between which one or more intermediate supports extend. The number of intermediate supports required depends on the length of the weaving heddle frame. The intermediate supports stabilize the frames as they move up and down while weaving, insuring that the upper and lower staves of each frame reamin parallel and the desired distance apart so that the heddles do not bind and can slide freely on them.

None of the intermediate supports in the prior art is readily slideable on the staves; and in some instances, the supports must be entirely removed in order to relocate them and allow the heddles to slide properly. Unfortunately, weaving heddles take their final position only after the commencement of a weaving process. If the intermediate support is of a fixed position design, the support must be completely removed to allow the heddles and yarn ends to pass by it; and it must then be reinstalled. On the other hand, if the intermediate support is of a slideable design, fasteners on both the top and the bottom of the support must be loosened before it can be slid to the desired position and then secured in place again. In either case, removing or sliding intermediate supports is a time-consuming and difficult task in part because of the many fasteners which must be loosened and then tightened on both the upper and lower frame staves. Moreover, special tools are frequently required as well.

The problems which arise in connection with the installation and removal of the intermediate supports are compounded by the facts that the number of weaving heddle frames in a weaving heddle loom is large, ranging from six to thirty-two. Further, the frames are very close together. To gain access to an intermediate support, the operator must spread the top frame staves apart and reach down between the frames to loosen or tighten the required fasteners.

Rigid intermediate supports for weaving heddle frames are shown in U.S. Pat. Nos. 4,658,864, 4,635,685, 3,417,790, 2,909,199, and 2,037,381. Various problems involved in the installation and removal of such intermediate supports are disclosed in these patents. In particular, U.S. Pat. No. 4,658,864 shows an intermediate support having threaded screws which are located on the underside of the lower frame stave making them almost inaccessible. U.S. Pat. No. 4,635,685 also shows a combination in which two screws must be replaced on the lower stave. A slideable intermediate support shown in U.S. Pat. No. 3,417,790 is held in position by two screws on the lower stave as well as two on the underside of the upper stave. Relocating this support presents an added problem in that guides to insure that it is being secured in a vertical position, perpendicular to the staves, are missing.

Other rigid intermediate supports are disclosed in U.S. Pat. Nos. 2,909,199 and 2,037,381. The latter support comprises a rigid rod surrounded by a hollow tube. The rigid rod must be raised completely in order to remove the tube and allow the heddles to slide by. U.S. Pat. No. 2,909,199 also discloses a rigid rod which must be raised through the upper frame stave to allow the heddles to slide past the intermediate support.

U.S. Pat. No. 4,475,574, on the other hand, shows a flexible intermediate support connected to the heddle carrying rods; but this support is not fixedly mounted on the frame staves and transmits only tensile forces between the rods. In the event compressive forces were to act on the rods during a weaving process, this intermediate support could be dislodged, causing disaster.

In my prior pending U.S. patent application identified above, there has been disclosed an intermediate support for a weaving heddle frame that carries both tensile and compressive forces between the upper and lower frame staves, in which the lower end of the support is easily connected to or removed from the lower frame stave. This intermediate support comprises a flexible cable on which is strung a segmented, rigid hollow member. The cable is retained in a position perpendicular to the upper and lower frame staves with the use of slotted holders fixedly attached thereto. The slotted holder on the lower stave is also employed to retain an end plug connected to the cable. The only fasteners on the intermediate support which must be alternately loosened and tightened are those disposed in a cable tensioning device mounted at the top of the upper frame stave, making the fasteners easily accessible and eliminating the use of any fasteners which must be loosened or tightened under the upper frame stave.

When the tensioning device in this intermediate support is employed to apply tension to the cable, the end plug presses against the holder, lifting the lower frame stave upwardly and into contact with the lower end of the rigid hollow member. Simultaneously, the upper frame stave is forced downwardly and into contact with the upper end of the rigid hollow member. Thus the cable transmits a tensile force while the rigid hollow member carries a compressive force, as required to maintain the upper and lower frame staves in a desired predetermined parallel relationship with each other so that the heddle can slide freely, without binding, along heddle carrying rods of the weaving heddle frame.

In certain weaving heddle frames, the position of the heddle carrying rods relative to the frame staves requires that an intermediate support in which the upper and lower ends of the rigid hollow member contact the upper and lower frame staves, include offsets. These offsets, when needed, are formed in those portions of the rigid hollow member contiguous with the heddle carrying rods. Unfortunately, such offsets tend to reduce the strength of the intermediate support when it acts as column exerting compressive loads between the upper and lower frame staves.

SUMMARY OF THE INVENTION

The subject invention is directed to improvements over applicant's prior teachings by way of an intermediate support for use in weaving harness frames in which the heddle carrying rods are firmly affixed, by rivets or the like, to the frame staves. In such frames, each heddle carrying rod acts as part of the contiguous stave structure and adds strength and stiffness to the stave, so that the stave tends to deflect less during the weaving process. The intermediate support according to the present invention is employed to exert compressive loads as a column between the upper and lower heddle carrying rods, rather than between the frame staves, when the rods are firmly affixed to the staves.

In the preferred embodiment, the intermediate support comprises a flexible member such as a cable on which is strung an unitary, rigid hollow member. The upper and lower ends of the rigid hollow member are adapted to abut the upper and lower heddle carrying rods, respectively. A tensioning device, mounted proximate with the top of the upper frame stave, is connected to the upper end of the cable and an end plug to the lower end thereof. To utilize this device to apply tension to the cable, the end plug is suitably positioned within a slotted holder on the lower stave. Then, as tension is applied, the end plug presses against the holder lifting the lower frame stave upwardly and bringing the lower heddle carrying rod into contact with the lower end of the rigid hollow member. Simultaneously, the upper frame stave is forced downwardly and brings the upper heddle carrying rod into contact with the upper end of the rigid hollow member. Under tension, the cable is retained in position perpendicular to the upper and lower frame staves by slotted holders fixedly attached thereto.

Moreover, when one or more of the heddles carrying warp yarn must be moved from one side to the other of the intermediate support, the operator need not remove the cable and hollow member altogether. Rather he simply loosens the tensioning device to free the end plug from the lower slotted holder, spreads the upper and lower frame staves apart by hand, and, flexing the cable as required, swings the rigid hollow member upwardly in a direction parallel to the warp ends and above them. Once the heddles and yarn have been moved sideways past the intermediate support, the procedure is then reversed. When the end plug is seated in the lower slotted holder, the tensioning device is again employed to apply tension to the cable.

In an alternate embodiment, the intermediate support comprises a segmented, rigid hollow member strung on the flexible cable. The upper and lower ends of the rigid hollow member are adapted to abut the upper and lower heddle carrying rods, respectively. The rigid hollow member includes at least two rigid hollow segments having contiguous ends which are nestable. Preferably, the segments together form a rigid hollow member which, when used to apply compressive loads to the heddle carrying rods, presents a smooth surface to any warp ends that are in contact with it.

In a further alternate embodiment, the rigid hollow member includes a structure with an elongated channel for the cable and a single, continuous protrusion on the side of the structure. This protrusion extends both laterally from each end of the channel and in a direction generally parallel to the longitudinal centerline thereof. The protrusion and structure form a pair of steps for retaining the structure in a position in which the channel is situated generally between the heddle carrying rods and in which the upper and lower ends of the structure abut the upper and lower heddle carrying rods, respectively. When the structure is so retained, the distal ends of the protrusion are contiguous with the vertical sides of the rods, with a portion of each rod being situated between one of these distal ends and the cable. The steps facilitate maintaining contact between the ends of the rigid hollow member and the heddle carrying rods during the weaving process. With this embodiment, the procedure for removing the intermediate support so that the heddles of warp yarn can be moved past it may entail, depending upon the flexibility of the frame staves, an additional operation. This operation is one of sliding the ends of the rigid hollow member along the heddle carrying rods until it assumes a substantially non-vertical position, moving the rigid hollow member through the space between the heddle carrying rods, and then uprighting it so that it can be swung upwardly in a direction parallel to the warp ends and above them.

In a still further alternate embodiment, the intermediate support comprises a rigid hollow member having a structure defining an elongated channel through which the cable passes and a pair of protrusions on the same side of the structure. These protrusions extend both laterally from the ends of the channel and in a direction generally parallel to the longitudinal centerline thereof, the structure and each protrusion forming a step. When the upper protrusion extends a sufficient distance upwardly of the step which it forms with the structure, the upper protrusion abuts the lower edge of the upper frame stave. Similarly, when the lower protrusion extends a sufficient distance downwardly of the step which it forms with the structure, the lower protrusion abuts the upper edge of the lower frame stave. In an intermediate support according to the present invention in which upper and lower protrusions abut the upper and lower frame staves, respectively, when tension is applied to the cable, the protrusions carry at least part of the compressive forces holding the frame staves apart and the heddle carrying rods in parallel relationship.

Other objects, features, and advantages of the present invention will become apparent from the following description when taken in conjunction with the accompanying drawing wherein like characters of reference designate corresponding parts throughout the several views.

DETAILED DESCRIPTION OF THE PREFERRED EMBODIMENTS

Figure 1:
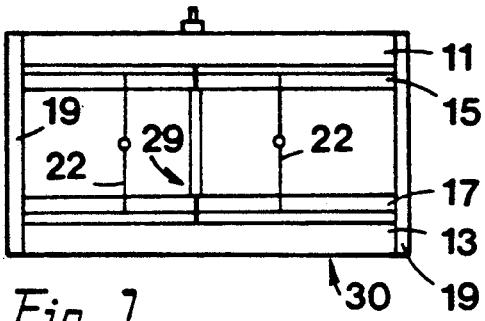
FIG. 1 is an elevation view of a weaving heddle frame with an intermediate support according to the present invention.
Figure 8:
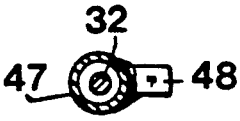
FIG. 8 is a cross section 8—8 through the rigid hollow member in FIG. 7.

Referring now to the drawings, the intermediate support of the present invention is denoted generally by the reference numeral 29. As illustrated in FIG. 1, a weaving heddle frame includes an upper frame stave 11, a lower frame stave 13, an upper heddle carrying rod 15 connected to the upper frame stave 11, a lower heddle carrying rod 17 connected to the lower frame stave 13, two end stays 19, and an intermediate support 29 for maintaining the upper and lower heddle carrying rods in parallel relationship so that heddles 22 can slide along them.

Figure 2:
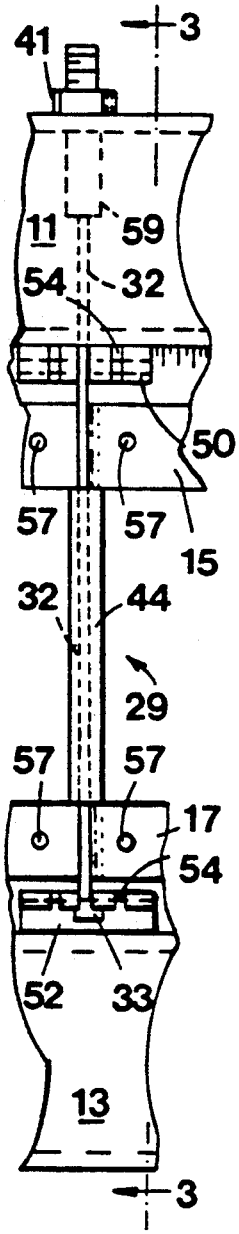
FIG. 2 is an enlarged view of a fragmentary section of a weaving heddle frame with an intermediate support according to the present invention.
Figure 3:
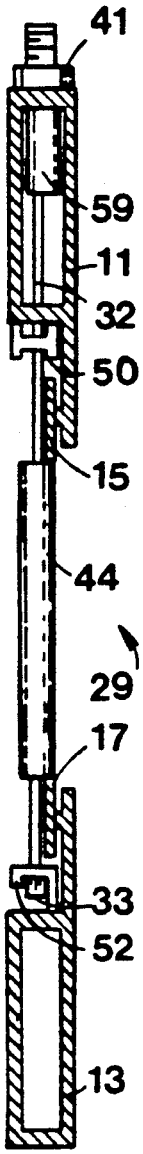
FIG. 3 is a cross section 3—3 through the weaving heddle frame in FIG. 2.

As is best seen in FIGS. 2 and 3, the intermediate support 29 comprises a flexible member such as a strand or cable 32 partially surrounded by a rigid hollow member 44. The distal ends of the cable 32 are connected to an end plug 33 and to tensioning means. In the preferred embodiment, the tensioning means comprises a threaded plug 59 threadly engageable with at least one nut 41 on the top of the upper frame stave 11. At the same time the threaded plug 59 is engaged by the nut 41, the end plug 33 can be seated in a lower slotted holder 52 attached to the lower frame stave 13 (FIG. 2). Tension can be applied to the cable 32 by turning the nut 41 so as to raise the end plug 33 against the lower holder 52.

A slotted holder 50 for receiving the cable 32 is also fixedly attached to the upper frame stave 11 (FIGS. 2 and 3). To maintain the cable 32 in a position in which it is perpendicular to the upper and lower frame staves 11, 13, the cable is stretched between vertically aligned slots 54 in the holders 50, 52. In the preferred embodiment, each of the holders 50, 52 has at least three slots which are spaced a uniform distance apart (FIG. 2). The plurality of slots 54 in each of the holders 50, 52 allows the intermediate support 29 to be shifted transversely along the staves 12, 14, without losing its perpendicularity with respect to them. An installer need simply insert the cable 32 in the desired vertically aligned pair of slots 54.

Fasteners such as screws (not shown) are employed to secure them to the underside of the upper frame stave 11 and to the upper edge of the lower frame stave 13, respectively.

The intermediate support as thus far described follows the teachings of my copending U.S. application Ser. No. 558,230, filed July 26, 1990 allowed.

Many of the harness frames used in high speed weaving today have heddle carrying rods firmly affixed to the frame staves by rivets or the like, so that each rod acts as a part of the stave structure, and adds strength and stiffness to the stave. In such frames, the staves are known to deflect less than would otherwise be the case during the weaving process.

In accordance with the present invention, there is provided an intermediate support 29 with a rigid hollow member 44 having ends adapted to abut the upper and lower heddle carrying rods 15, 17, respectively, rather than the frame staves 11, 13 themselves to which the rods are affixed by rivets 57. When tension is applied to the cable 32 by turning the nut 41 so as to raise the end plug 33 against the lower holder 52, the holder lifts the lower frame stave 13 upwardly as well as the lower heddle carrying rod 17, bringing it into contact with the lower end of the rigid hollow member 44. Simultaneously, the upper frame stave 11 is forced downwardly, bringing the rod 15 affixed thereto into contact with the upper end of the rigid hollow member 44. Tension forces in the cable 32 are then balanced by compressive forces being exerted on the rigid hollow member 44, holding the rods 15, 17 apart. When the rigid hollow member 44 is of proper length, the heddles 22 can be slid freely, without binding, along the rods 15, 17.

Figures 9, 10, 11, 12:
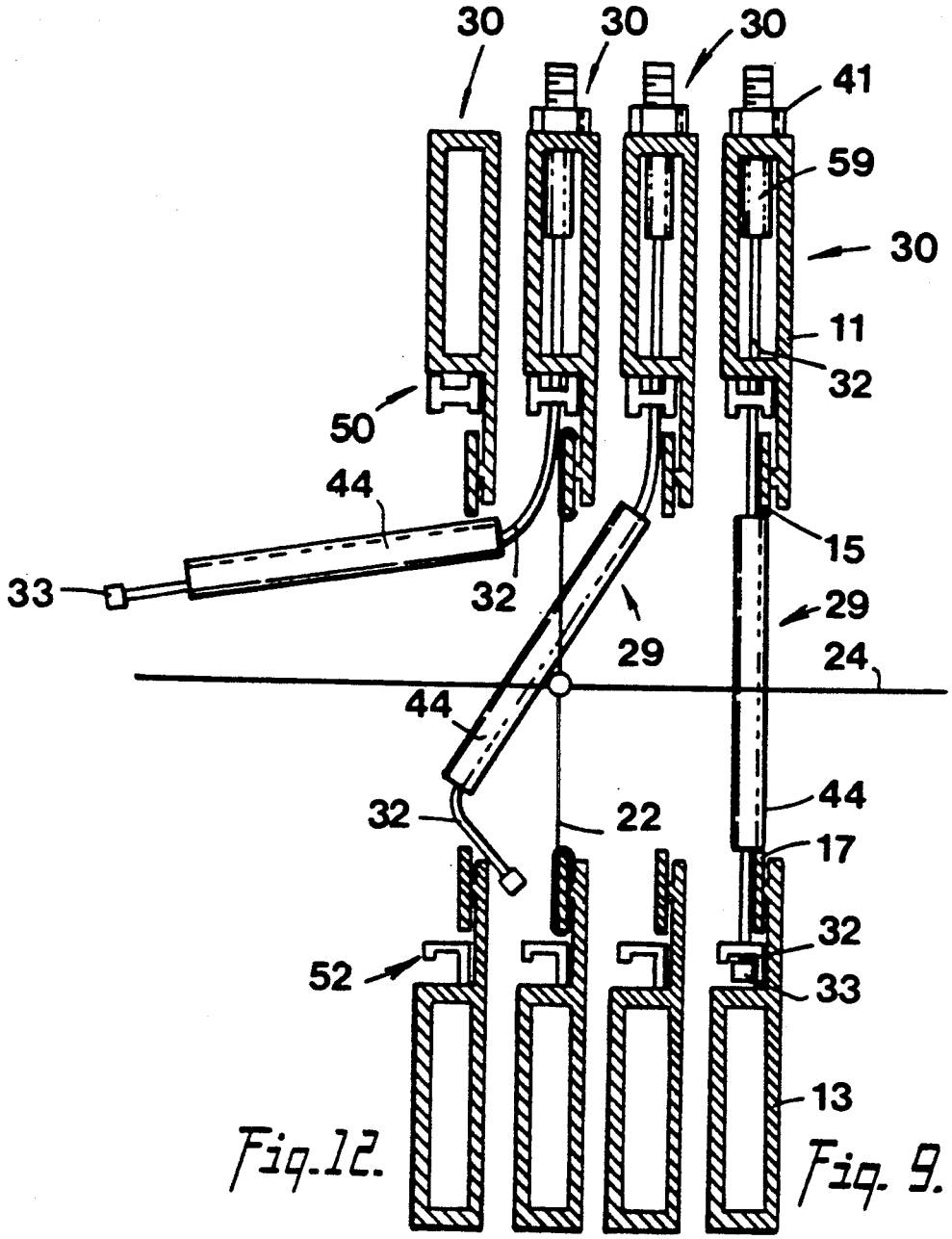
FIG. 9 is a cross section similar to that in FIG. 3 but with the intermediate support loosened.
FIG. 10 is a cross section similar to that in FIG. 9 except that the intermediate support is in a flexed position.
FIG. 11 is a cross section similar to that in FIG. 9 except the lower end of the intermediate support has been swung upwardly and above the warp ends.
FIG. 12 is a cross section similar to that in FIG. 9 except that the intermediate support has been removed.

As illustrated in FIGS. 9 through 12, weaving heddle frames 30, as they are used in a weaving loom, are used in close proximity to each other. When the heddles 22 must be slid along the rods 15, 17 past the intermediate support 29, the nut 41, on the top of the upper frame stave 12, is first loosened, moving the threaded plug 59 and the end plug 33 downwardly (FIG. 9). Once the plug 33 has been removed from the holder 52, the frame staves 11, 13 are spread apart by hand, freeing the rigid hollow member 44. The slackness of the flexible cable 32 is sufficient to allow it to be bent at an angle of approximately 90 degrees, so that the the rigid hollow member 44 can be swung over the lower heddle carrying rod 17 on the adjacent weaving heddle frame 30. Once the intermediate support 29 has been swung upwardly even further to points above the level of the warp yarn end 24 and away from the upper heddle carrying rod 15, the heddle 22 can be slid along the rods 15, 17, thereby moving the warp end 24 past the intermediate support 29.

Figure 4:
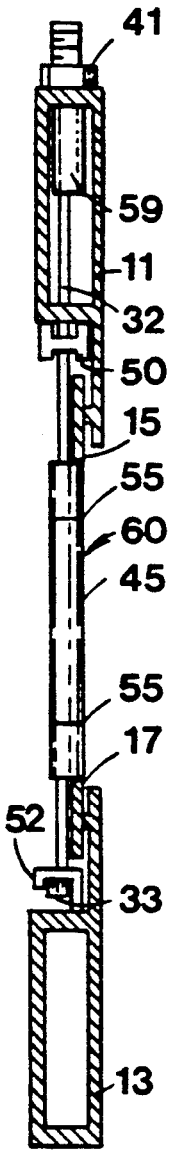
FIG. 4 shows a modification of FIG. 3 in which the intermediate support has a segmented rigid hollow member.

In an alternate embodiment, there is provided an intermediate support 60 with a rigid hollow member 45 having at least two rigid hollow segments (FIG. 4). Contiguous pairs of these segments abut each other at junctures 55. The ends of contiguous segments of the member 45 can be nested and are so shaped that under tension, the longitudinal axes of the segments are aligned with each other. Suitable nestable ends for these segments are disclosed in my copending U.S. application Ser. No. 558,230, filed July 26, 1990. Each of the preferred embodiments of the nestable ends disclosed therein meets a critical requirement for an intermediate support: namely, that, when the warp ends carried by an adjacent frame 30 are raised or lowered, they must not hang or catch on the intermediate support 60.

Figure 6:
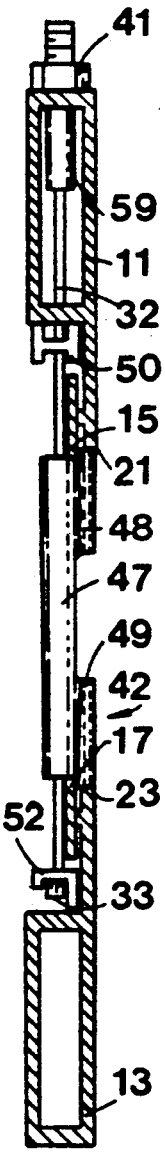
FIG. 6 shows a modification of FIG. 3 in which the rigid hollow member includes a pair of projections, each of which defines a step similar to the steps shown in FIG. 5.

In a further alternate embodiment, there is provided an intermediate support 42 with a rigid hollow member 47 having a structure defining an elongated channel through which the cable 32 passes and a pair of protrusions 48, 49 affixed to the structure by welding or the like. Alternately, the protrusions and the structure comprise a single, unitary piece. The protrusions 48, 49 extend from the same side of the structure proximate with the ends of the channel and in a direction generally parallel to the longitudinal centerline thereof (FIG. 6). The structure and each of the protrusions 48, 49 forms a step, which comprises means for retaining the rigid hollow member 47 in position between the heddle carrying rods 15, 17 during the weaving process. When the ends of structure abut these rods, the protrusions 48, 49 are in contact with the vertical sides of the rods 15, 17, with a portion of each rod being situated between one of the protrusions and the cable 32, so that contact between the ends of the rigid hollow member 47 and the rods 15, 17 can be maintained in the unlikely event the rods deflect during the weaving process. Moreover, when the cable 32 is being tightened, the rigid hollow member, in the absence of the protrusion 48, 49, can slide sideways and out of contact with heddle carrying rods. With the protrusions 48, 49 present, on the other hand, a portion of each heddle carrying rod 15, 17 is captured between the contiguous rod and the cable 32, preventing the ends of the rigid hollow member 47 from sliding out of contact with the rods.

Figure 7:
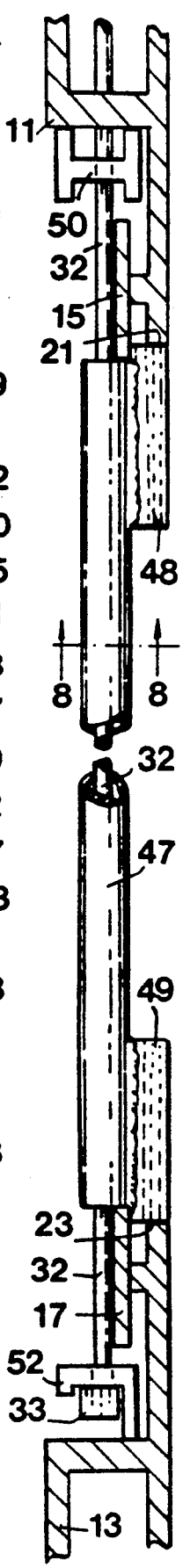
FIG. 7 is a cross section similar to that in FIG. 6 but more fragmentary and on an enlarged scale.

In the embodiment illustrated in FIGS. 6 and 7, the upper protrusion 48, when the cable 32 is properly tensioned, abuts the lower edge 21 of the upper frame stave 11; similarly, the lower protrusion 49 abuts the upper edge 23 of the lower frame stave 13. Consequently, at least part of the compressive load on the rigid hollow member 47 is transmitted between the protrusions and the frame staves 11, 13. Any remaining part of this compressive load is transmitted between the heddle carrying rods and the structure of the rigid hollow member defining the elongated channel for the cable 32. In situations in which the heddle carrying rods are not sufficiently strong or rigid, the protrusions 48, 49 are preferably elongated slightly to increase the distance between their distal ends so that all of the compressive load is transmitted between the protrusions and the frame staves.

Figure 5:
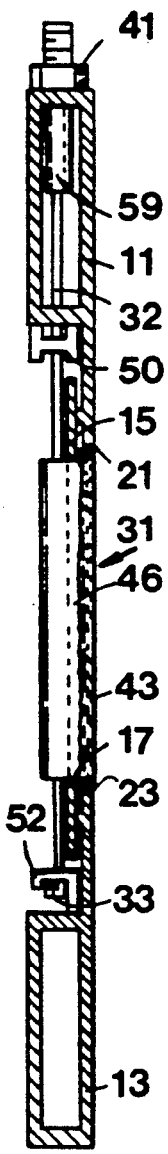
FIG. 5 shows a modification of FIG. 3 in which the rigid hollow member includes a projection forming a pair of steps disposed proximate with its ends, the projection and a cable on which the member is strung sandwiching portions of the heddle carrying rods therebetween.

Alternately, as shown in FIG. 5, an intermediate support 31, similar to the support 42, comprises a rigid hollow member 46 having a structure with an elongated channel for the cable 32 and a continuous protrusion 43 affixed by welding or the like to the structure or forming a single, unitary piece with it. The protrusion 43 extends longitudinally from points on the structure proximate with each end of the channel and in a direction generally parallel to its longitudinal centerline. The protrusion 43 and the structure together form a pair of steps for retaining the rigid hollow member 46 in position between the rods 15, 17. The total length of the protrusion 43 determines whether any portion of the compressive load on the rigid hollow member 46, when the cable 32 is under tension, is transmitted between the ends of the protrusion 43 and the frame staves 11, 13.

When heddles 22 carrying warp yarn must be moved from one side to the other of the intermediate support 31, 42, the operator need not remove the cable 32 and hollow member 46, 47 from the frame 30. As with the supports 29, 60, he simply loosens the nut 41 sufficiently to free the end plug 33 from the lower slotted holder 52, disengages the end plug from this holder, and spreads the upper and lower frame staves 11, 13 apart, using hand pressure. Before swinging the rigid hollow member 46, 47 upwardly, however, he may, depending upon the flexibility of the frame staves 11, 13, need to slide the ends of the rigid hollow member 46, 47 along the heddle carrying rods 15, 17 until it assumes a substantially nonvertical position. He can then move the rigid hollow member 46, 47 through the space between the heddle carrying rods 15, 17, upright the rigid hollow member and thereafter swing it upwardly in a direction parallel to the warp ends and above them. To reverse this procedure, the rigid hollow member 46, 47 is swung downwardly; the upper and lower frame staves 11, 13 are spread apart; the rigid hollow member is tilted, as required, to accomodate it so that respective protrusions at the ends of the member 46, 47 can be slipped properly over the edges of the rods 15, 17, sandwiching them between the protrusions and the cable 32; the end plug 33 is seated in the lower slotted holder 52; and tension is again applied to the cable 32 by tightening the nut 41.

It will be obvious to those skilled in the art that many variations may be made in the preferred embodiments, chosen for the purpose of illustrating the best mode of making and using the present invention, without departing from the scope thereof as defined by the appended claims.

What is claimed is:

1. In a weaving heddle frame having upper and lower heddle carrying rods affixed to upper and lower frame staves, respectively, the combination with said heddle carrying rods of an intermediate support having:

(a) a flexible member connected to the upper frame stave;

(b) a rigid hollow member surrounding a portion of the flexible member and extending generally from the upper edge of the lower heddle carrying rod to the lower edge of the upper heddle carrying rod;

(c) means for detachably mounting the lower end of the flexible member on the lower frame stave; and (d) means disposed at the upper end of the flexible member for tensioning the flexible member, the tensioning means transmitting tensile force in the flexible member to urge the lower frame stave upward and to bring the lower heddle carrying rod affixed thereto into contact with the lower end of the hollow member and to urge the upper frame stave downward and to bring the upper heddle carrying rod into contact with the upper end of the hollow member while the rigid hollow member exerts compressive force simultaneously upon the upper and lower heddle carrying rods to hold them in a spaced apart relationship.

2. The intermediate support according to claim 1 which further comprises an end plug affixed to the lower end of the flexible member and a lower holder attached to the lower frame stave, the lower holder having a slot and a recess for receiving the flexible member and the end plug, respectively; the slot and the recess communicating with each other, so that when the flexible member is seated within the slot and pulled upwardly to a sufficient extent, the end plug seats itself in the recess.

3. The intermediate support according to claim 1 which further comprises a first holder secured to the lower frame stave, the first holder having a plurality of vertical slots for receiving the flexible member.

4. The intermediate support according to claim 3 which further comprises a second holder mounted on the upper frame stave, the second holder having a plurality of vertical slots for receiving the flexible member, each of the slots in the first holder being aligned vertically with one of the slots in the second holder, thereby facilitating the alignment of the flexible member in a position in which the flexible member is disposed perpendicularly to the upper and lower frame staves.

5. The intermediate support according to claim 1 wherein the flexible member tensioning means further comprises a threaded plug connected to the upper end of the flexible member and means affixed to the upper frame stave for engaging the threaded plug.

6. An intermediate support for a weaving heddle frame having upper and lower heddle carrying rods affixed to upper and lower frame staves, respectively, comprising:

(a) a flexible member connected to the upper frame stave;

(b) a rigid hollow member comprising at least two rigid hollow segments, the rigid hollow member surrounding a portion of the flexible member and extending generally from the upper edge of the lower heddle carrying rod to the lower edge of the upper heddle carrying rod;

(c) means for detachably mounting the lower end of the flexible member on the lower frame stave; and (d) means disposed at the upper end of the flexible member for tensioning the flexible member, the tensioning means transmitting tensile force in the flexible member to urge the lower frame stave upward and to bring the lower heddle carrying rod affixed thereto into contact with the lower end of the hollow member and to urge the upper frame stave downward and to bring the upper heddle carrying rod affixed thereto into contact with the upper end of the hollow member while the rigid hollow member exerts compressive force simultaneously upon the upper and lower heddle carrying rods to hold them in a spaced apart relationship.

7. The intermediate support according to claim 6 which further comprises means, disposed on the ends of each pair of rigid hollow segments which are situated contiguous with each other, for nesting said ends so that one of the ends can be disposed within the other, the longitudinal axes of the rigid hollow segments being aligned with each other when the ends of each of the contiguous pairs of segments are nested.

8. In a weaving heddle frame having upper and lower frame members in which upper and lower heddle carrying rods are affixed to upper and lower frame staves, respectively, the combination with said frame members of an intermediate support comprising:

(a) a flexible member connected to the upper frame stave;

(b) a rigid hollow member surrounding a portion of the flexible member, the rigid hollow member being extendable generally from the upper edge of the lower heddle carrying rod to the lower edge of the upper heddle carrying rod;

(c) means for detachably mounting the lower end of the flexible member on the lower frame stave; and (d) means disposed at the upper end of the flexible member for tensioning the flexible member, the tensioning means transmitting tensile force in the flexible member to urge the lower frame member upward and into contact with the rigid hollow member and to urge the upper frame member downward and into contact with the rigid hollow member, thereby exerting compressive and tensile forces simultaneously upon the upper and lower frame members to hold the upper and lower heddle carrying rods in a spaced apart relationship.

9. The intermediate support according to claim 8 wherein the rigid hollow member further comprises a structure and a pair of protrusions, the structure defining an elongated channel through which the flexible member passes, each protrusion extending from points proximate with an end of the channel and in a direction generally parallel to the longitudinal centerline thereof, each protrusion forming a step with the structure so that a portion of one of the heddle carrying rods can be sandwiched between the protrusion and the flexible member, thereby facilitating contact between the rigid hollow member and the heddle carrying rods when the rigid hollow member is extended between them during weaving.

10. The intermediate support according to claim 8 wherein the rigid hollow member further comprises a structure having a sidewall, the structure defining an elongated channel through which the flexible member passes, and protrusion means for abutting edges of the lower and upper frame staves simultaneously, the protrusion means comprising at least one protrusion extending from the sidewall of the structure.

11. The intermediate support according to claim 8 wherein the rigid hollow member further comprises a structure and a protrusion, the structure defining an elongated channel through which the flexible member passes, the protrusion extending from points proximate with each end of the channel and in a direction generally parallel to the longitudinal centerline thereof, the protrusion forming a step with the structure proximate with each end of the channel, so that a portion of each of the heddle carrying rods can be sandwiched between the protrusion and the flexible member, thereby facilitating contact between the rigid hollow member and the heddle carrying rods when the rigid hollow member is extended between them during weaving.

* * * * *